US012150549B2

(12) United States Patent
Xi

(10) Patent No.: US 12,150,549 B2
(45) Date of Patent: Nov. 26, 2024

(54) LINEAR MOTION MECHANISM, DRAWER ASSEMBLY, AND STORAGE CABINET

(71) Applicants: HEFEI MIDEA REFRIGERATOR CO., LTD., Hefei (CN); HEFEI HUALING CO., LTD., Hefei (CN); MIDEA GROUP CO., LTD., Foshan (CN)

(72) Inventor: Yongxue Xi, Hefei (CN)

(73) Assignees: HEFEI MIDEA REFRIGERATOR CO., LTD., Hefei (CN); HEFEI HUALING CO., LTD., Hefei (CN)

( * ) Notice: Subject to any disclaimer, the term of this patent is extended or adjusted under 35 U.S.C. 154(b) by 80 days.

(21) Appl. No.: 17/925,013

(22) PCT Filed: Dec. 29, 2021

(86) PCT No.: PCT/CN2021/142520
§ 371 (c)(1),
(2) Date: Nov. 14, 2022

(87) PCT Pub. No.: WO2022/193778
PCT Pub. Date: Sep. 22, 2022

(65) Prior Publication Data

US 2023/0180931 A1 Jun. 15, 2023

(30) Foreign Application Priority Data

Mar. 16, 2021 (CN) ..... 202110282980.9

(51) Int. Cl.
*F25D 25/02* (2006.01)
*A47B 88/453* (2017.01)
(Continued)

(52) U.S. Cl.
CPC ..... *A47B 88/453* (2017.01); *A47B 88/457* (2017.01); *A47B 88/49* (2017.01);
(Continued)

(58) Field of Classification Search
CPC ..... A47B 88/453; A47B 88/49; A47B 88/457; A47B 88/493; A47B 88/40; A47B 88/447;
(Continued)

(56) References Cited

U.S. PATENT DOCUMENTS 7,928,684 B2 * 4/2011 Hauer ..... F16D 41/105 318/532
11,202,504 B2 * 12/2021 Kim ..... A47B 88/493
(Continued)

FOREIGN PATENT DOCUMENTS

AT 516675 A2 * 7/2016 ..... A47B 88/493
CN 203928564 U 11/2014
(Continued)

OTHER PUBLICATIONS

International Search Report mailed Mar. 29, 2022 for PCT Application No. PCT/CN2021/142520.
(Continued)

*Primary Examiner* — Kimberley S Wright

(57) ABSTRACT

A linear motion mechanism, a drawer assembly, and a storage cabinet, relating to the technical field of linear motion. The linear motion mechanism comprises a rotating wheel around which a flexible cable is wound, the flexible cable being suitable for moving along with rotation of the rotating wheel, and the flexible cable comprising flexible cable sections located on the two sides of the rotating wheel; a rotation driving member which is connected to the rotating wheel and suitable for driving the rotating wheel to rotate; a mounting member, the mounting member being provided with a guide rail, a first fixed pulley being mounted on the mounting member; and a first-stage sliding rail which is suitable for sliding relative to the guide rail.

15 Claims, 8 Drawing Sheets

(51) Int. Cl.

| | |
|---|---|
| ***A47B 88/457*** | (2017.01) |
| ***A47B 88/49*** | (2017.01) |
| ***A47B 88/493*** | (2017.01) |
| *A47B 67/04* | (2006.01) |
| *A47B 88/40* | (2017.01) |
| *A47B 88/447* | (2017.01) |
| *A47F 3/06* | (2006.01) |

(52) U.S. Cl.
CPC ..... *F25D 25/025* (2013.01); *A47B 67/04* (2013.01); *A47B 88/40* (2017.01); *A47B 88/447* (2017.01); *A47F 3/063* (2013.01)

(58) Field of Classification Search
CPC ..... A47B 2210/175; A47B 2210/007; A47B 2210/0072; F25D 25/025; A47F 3/063
See application file for complete search history.

(56) References Cited

U.S. PATENT DOCUMENTS

| | | | | |
|---|---|---|---|---|
| 2004/0017139 | A1 | 1/2004 | Mueller et al. | |
| 2009/0230795 | A1* | 9/2009 | Hauer | A47B 88/457 310/76 |
| 2010/0090571 | A1 | 4/2010 | Gasser | |
| 2011/0050061 | A1 | 3/2011 | Gasser | |
| 2020/0345139 | A1* | 11/2020 | Kim | A47B 88/437 |
| 2021/0199155 | A1* | 7/2021 | Zou | F16C 29/04 |

FOREIGN PATENT DOCUMENTS

| | | | | |
|---|---|---|---|---|
| CN | 107989501 | A | * | 5/2018 |
| CN | 108916226 | A | | 11/2018 |
| CN | 210329882 | U | | 4/2020 |
| CN | 111568080 | A | | 8/2020 |
| CN | 212066094 | U | | 12/2020 |
| CN | 112240666 | A | | 1/2021 |
| CN | 212585282 | U | | 2/2021 |
| CN | 112956846 | A | | 6/2021 |
| DE | 19921872 | A1 | | 11/2000 |
| WO | 2009108970 | A1 | | 9/2009 |
| WO | 2020242393 | A1 | | 12/2020 |

OTHER PUBLICATIONS

EESR Received in EP App No. 21931350.9; mailed Oct. 23, 2023.
First OA received in CN Application No. 202110282980.9; mailed Dec. 27, 2023.

* cited by examiner

LINEAR MOTION MECHANISM, DRAWER ASSEMBLY, AND STORAGE CABINET

CROSS-REFERENCES TO RELATED APPLICATIONS

The present disclosure is a national phase application of International Application No. PCT/CN2021/142520, filed on Dec. 29, 2021, which claims priority to Chinese Application No. 202110282980.9, filed on Mar. 16, 2021, the entireties of which are herein incorporated by reference.

FIELD

The present application relates to the technical field of linear motion technologies, in particular to a linear motion mechanism, a drawer assembly, and a storage cabinet.

BACKGROUND

Linear motion mechanism is applied in many products. For example, for a refrigerator, in order to achieve a linear motion of a drawer body relative to a box body of the refrigerator, to make the drawer body extend out of the box body or be taken back to the box body, a linear motion mechanism should be installed between the drawer body and the box body.

The linear motion mechanism in the related art can only switch states under an operation of an external force. Even if the linear motion mechanism of a small number of existing products can automatically switch states, but it will add a lot of additional special members, which will lead to large space occupation, complex structure, high cost and inconvenient assembly and disassembly of the linear motion mechanism.

SUMMARY

An objective of the present application is to solve at least one of the problems existing in the related art. To this end, the present application provides a linear motion mechanism, which only needs to be added with a rotating wheel, a rotating driving member and a pulley to operate automatically (where the pulley includes a fixed pulley and can further include a movable pulley, and the fixed pulley refers to at least one of a first fixed pulley, a second fixed pulley, and a third fixed pulley in the absence of specific limitations), and then has small space occupation and simple structure without greatly increasing a preparation cost of the linear motion mechanism, and can be assembled or disassembled conveniently.

The present application further provides a drawer assembly.

The present application further provides a storage cabinet.

The linear motion mechanism provided by the embodiments of the present application includes:

a rotating wheel, wrapped by a flexible cable, where the flexible cable is configured to move as the rotating wheel rotating, and the flexible cable includes flexible cable segments located on two sides of the rotating wheel;

a rotating driving member, connected with the rotating wheel, and configured to drive the rotating wheel to rotate;

an installation member, provided with a guiding rail, a first fixed pulley being installed on the installation member; and a first-stage sliding rail, configured to slide relative to the guiding rail, where the flexible cable wraps the first fixed pulley, and the flexible cable segment of the flexible cable located on the two sides of the rotating wheel are connected to the first-stage sliding rail.

According to the linear motion mechanism provided by the embodiments of the present application, the linear motion mechanism only needs to be added with a rotating wheel, a rotating driving member and a pulley to operate automatically (where the pulley includes a fixed pulley and can further include a movable pulley, and the fixed pulley refers to at least one of a first fixed pulley, a second fixed pulley, and a third fixed pulley in the absence of specific limitations), and then has small space occupation and simple structure without greatly increasing the preparation cost of the linear motion mechanism. In addition, since only the assembly and disassembly of the rotating wheel, the rotating driving member and the pulley are involved, the assembly and disassembly are more convenient.

According to an embodiment of the present application, a number of intermediate sliding rails are provided between the first-stage sliding rail and the guiding rail, and the first-stage sliding rail is installed on the guiding rail through the intermediate sliding rails, the intermediate sliding rail is provided with a movable pulley, and the flexible cable wraps the first fixed pulley and the movable pulley in sequence.

According to an embodiment of the present application, the linear motion mechanism further includes:

a second-stage sliding rail, installed on the guiding rail, configured to slide along the guiding rail, and provided with a first movable pulley and a second movable pulley, where the first-stage sliding rail is installed on the second-stage sliding rail and is configured to move relative to the second-stage sliding rail; and the flexible cable wraps the first fixed pulley, the first movable pulley and the second movable pulley in sequence.

According to an embodiment of the present application, the linear motion mechanism further includes:

a sliding block, fixed on the first-stage sliding rail and configured to perform linear motion along the second-stage sliding rail, and fixedly connected to the flexible cable segment on the two sides of the rotating wheel.

According to an embodiment of the present application, the sliding block is fixed at a back end of the first-stage sliding rail along an extension direction of the first-stage sliding rail relative to the second-stage sliding rail.

According to an embodiment of the present application, the first movable pulley and the second movable pulley are respectively provided at two ends of the second-stage sliding rail.

According to an embodiment of the present application, the flexible cable includes:

a first flexible cable segment, located between the first fixed pulley and the first movable pulley;

a second flexible cable segment, located between the first movable pulley and the second movable pulley; and a third flexible cable segment, located between the second movable pulley and the first-stage sliding rail, where the first flexible cable segment, the second flexible cable segment and the third flexible cable segment are parallel, or angles are provided between the first flexible cable segment and the second flexible cable segment, and between the second flexible cable segment and the third flexible cable segment.

According to an embodiment of the present application, the rotating wheel is installed on the installation member.

According to an embodiment of the present application, when the linear motion mechanism further includes a second-stage sliding rail and a first movable pulley and a second movable pulley provided on the second-stage sliding rail, the rotating wheel is provided correspondingly to the first fixed pulley, the first movable pulley and the second movable pulley, a diameter of the rotating wheel is larger than diameters of the first fixed pulley, the first movable pulley and the second movable pulley.

According to an embodiment of the present application, the linear motion mechanism further includes:

a second fixed pulley, provided on the installation member, where the flexible cable wraps the second fixed pulley and the first fixed pulley in sequence.

where the first fixed pulley is located at a first end of the guiding rail, the second fixed pulley is located at a second end of the guiding rail, or the second fixed pulley is located on an extended path of the guiding rail and close to the second end of the guiding rail.

According to an embodiment of the present application, the rotating wheel is a belt wheel, and the flexible cable is a belt matching with the belt wheel.

The drawer assembly provided by the embodiments of the present application includes a drawer body, and further includes the linear motion mechanism mentioned above, where the drawer body is fixed on a first-stage pulley.

According to the drawer assembly provided by the embodiments of the present application, the rotating wheel is driven to rotate by the rotating driving member, and the flexible cable is led to move, to make the first-stage sliding rail slide relative to the sliding rail. When the drawer body is installed on the first-stage sliding rail, the drawer body can move relative to the installation member so that the drawer can be pulled automatically.

The storage cabinet provided by the embodiments of the present application includes a box body and a drawer body and/or a shelf provided in the box body, and further includes the linear motion mechanism mentioned above, where the linear motion mechanism is provided on at least one side of the drawer body and/or shelf, the drawer body and/or shelf are fixed on the first-stage sliding rail, and the installation member is fixed on the box body.

According to the storage cabinet provided by the embodiments of the present application, the drawer body and/or shelf can be pulled automatically, to facilitate the taking and placing of objects. In addition, the linear motion mechanism between the drawer body and/or shelf has small space occupation and simple structure, thereby hardly occupying additional space inside the box body. In addition, the preparation cost of the linear motion mechanism is low and is convenient to be assembled and disassembled, which has high applicability, and can be applied to various products such as refrigerators, wardrobes, and display cabinets.

According to an embodiment of the present application, the first-stage sliding rail and the installation member are provided along a height direction of the storage cabinet in sequence, and the first-stage sliding rail is fixed with a side wall of the drawer body or a side wall of the shelf.

According to an embodiment of the present application, the first-stage sliding rail and the installation member are provided sequentially along a width direction of the storage cabinet, and the first-stage sliding rail is fixed with a bottom plate of the drawer body or a bottom plate of the shelf.

According to an embodiment of the present application, the rotating wheel is installed on an inner side of the storage cabinet.

According to an embodiment of the present application, the storage cabinet can be a refrigerator, a retail cabinet or a display cabinet.

Additional aspects and advantages of the present application are set forth, in part, from the following description, and the part will become clear from the following description, or is learned by practice of the present application.

BRIEF DESCRIPTION OF THE DRAWINGS

To more clearly illustrate the embodiments of the present application or prior art, accompanying drawings used in the description of the embodiments or the prior art are briefly introduced below. It should be noted that, the drawings in the following description only show some embodiments of the present application. For those of ordinary skill in the art, other drawings may also be obtained according to these drawings without creative effort.

REFERENCE NUMERALS

Figure 1:
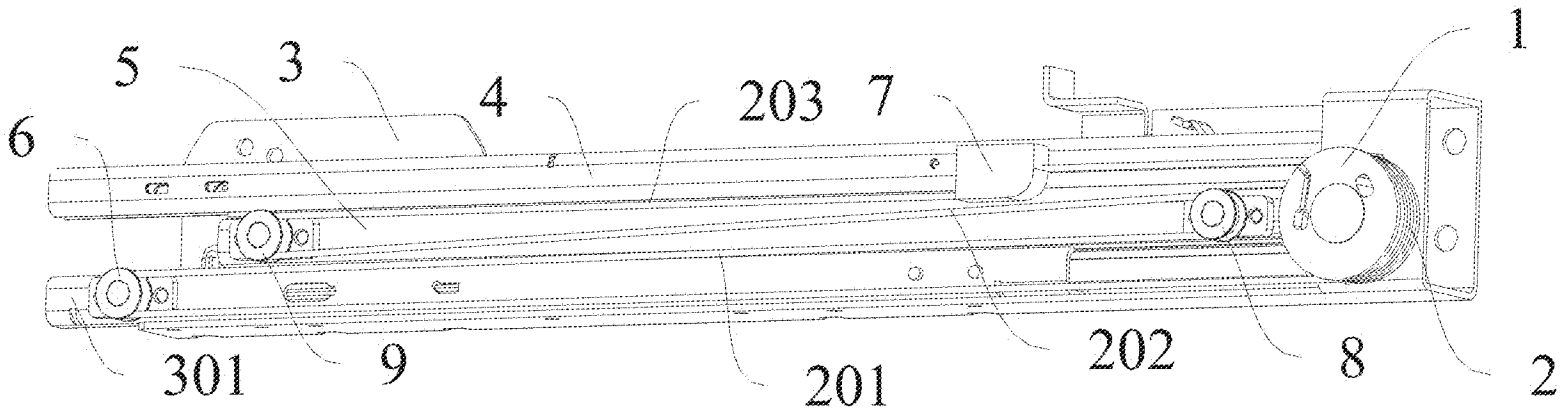
FIG. 1 is an axis side view of a linear motion mechanism provided by an embodiment of the present application, where a first-stage sliding rail and a second-stage sliding rail are in a retraction position.

1: rotating wheel; 2: flexible cable; 201: first flexible cable segment; 202: second flexible cable segment; 203: third flexible cable segment; 3: installation member; 301: guiding rail; 4: first-stage sliding rail; 5: second-stage sliding rail; 6: first fixed pulley; 7: sliding block; 8: first movable pulley; 9: second movable pulley; 10: second fixed pulley.

DETAILED DESCRIPTION OF THE DISCLOSURE

The implementation of the present application is further described in detail below in combination with the accompanying drawings and embodiments. The following embodiments are used to describe the present application, but cannot be used to limit the scope of the present application.

In the description of the present application, it is to be noted that, the orientation or positional relations specified by terms such as "central", "longitudinal", "transverse", "upper", "lower", "front", "back", "left", "right", "vertical", "horizontal", "top", "bottom", "inner", "outer" and the like, are based on the orientation or positional relations shown in the drawings, which is merely for convenience of description of the present application and to simplify description, but does not indicate or imply that the stated devices or members must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the stage height of the first feature is higher than that of the second feature. The first feature is "under", "below" and "beneath" the second feature can refer to that the first feature is directly below or obliquely below the second feature, or simply refer to that the stage height of the first feature is lower than that of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art may combine the different embodiments or examples described in this specification, as well as the features of the different embodiments or examples, without conflicting each other.

As shown in FIG. 1 to FIG. 7, the linear motion mechanism according to an embodiment of the present application includes a rotating wheel 1, a rotating driving member (not shown in the figures), an installation member 3 and a first-stage sliding rail 4. The rotating wheel 1 is wrapped by a flexible cable 2, where flexible cable 2 is configured to move as the rotating wheel 1 rotating, and the flexible cable 2 includes cable segments on two sides of the rotating wheel 1. The rotating driving member is connected with the rotating wheel 1, and is configured to drive the rotating wheel 1 to rotate. The installation member 3 is provided with a guiding rail 301, and the installation member 3 is provided with a first fixed pulley 6. The first-stage sliding rail 4 is configured to slide relative to the guiding rail 301. The flexible cable 2 wraps the first fixed pulley 6, and the flexible cable segment of the flexible cable 2 located on two sides of the rotating wheel 1 is connected to the first-stage sliding rail 4.

According to the linear motion mechanism provided by the embodiments of the present application, the linear motion mechanism only needs to be added with a rotating wheel 1, a rotating driving member and a pulley to operate automatically (where the pulley includes a fixed pulley, and can further include a movable pulley, and the fixed pulley refers to at least one of a first fixed pulley 6, a second fixed pulley 10, and a third fixed pulley in the absence of specific limitations), and then has small space occupation and simple structure without greatly increasing the preparation cost of the linear motion mechanism. In addition, since only involves the assembly and disassembly of the rotating wheel 1, the rotating driving member and the pulley are involved, the assembly and disassembly are more convenient.

According to the linear motion mechanism of the present application embodiment, the rotating driving member can lead the rotating wheel 1 to rotate, and then the rotating wheel 1 leads the flexible cable 2 to move. On this basis, since the flexible cable 2 wraps the first fixed pulley 6, and the flexible cable segment on two sides of the rotating wheel 1 is connected to the first-stage sliding rail 4, the flexible cable 2 can lead the first-stage sliding rail 4 to move linearly relative to the guiding rail 301. As rotation directions of the rotating wheel 1 varying, the first-stage sliding rail 4 performs linear motion in different directions relative to the guiding rail 301. In FIG. 1, when the rotating wheel 1 rotates clockwise, the flexible cable 2 lead s the first-stage sliding rail 4 to move towards a right side of FIG. 1 relative to the guiding rail 301. When the rotating wheel 1 rotates counterclockwise, the flexible cable 2 leads the first-stage sliding rail 4 to move towards a left side of FIG. 1 relative to the guiding rail 301.

It should be noted that the function of the linear motion mechanism is to make a certain point on the mechanism move accurately or approximately linearly. That is, the motion of the linear motion mechanism here includes approximate linear motion. In addition, for the pulley group including the flexible cable 2 and the first fixed pulley 6, the motion of the flexible cable 2 will only lead the first fixed pulley 6 to rotate without the changing spatial position of the first fixed pulley 6.

According to the embodiments of the present application, the structural form of guiding rail 301 is not limited. When the first-stage sliding rail 4 is directly provided on the guiding rail 301, the guiding rail 301 only needs to play a guiding role on the first-stage sliding rail 4. For example, the guiding rail 301 can include a guiding groove, and then the first-stage sliding rail 4 can move along an extension direction of the guiding groove; or, the guiding rail 301 can include a guiding protrusion, and then the first-stage sliding rail 4 can move along the extension direction of the guiding protrusion. In addition, the guiding rail 301 can be integrally formed on the installation member 3 or can be an individual member fixed to the installation member 3.

Similarly, the structural form of the first-stage sliding rail 4 is not limited, as long as it can form a guiding matching with the guiding rail 301, the first-stage sliding rail 4 can move linearly or approximately linearly relative to the guiding rail 301. For example, the first-stage sliding rail 4 and the guiding rail 301 can be matching by a matching protrusion and groove, or a sliding member such as a pulley can be provided between the sliding rail and the guiding rail 301, and then the first-stage sliding rail 4 and the guiding rail 301 are matched by the sliding member.

The first-stage sliding rail 4 can be an individual member, and can also be formed in a drawer, a shelf board, or the like. The drawer or shelf board configured to be installed on the guiding rail 301 can be taken as a first-stage sliding rail 4. A second-stage sliding rail 5 and a third-stage sliding rail can further be installed between the first-stage sliding rail 4 and the guiding rail 301. The first-stage sliding rail 4 is installed on the sliding rail through the second-stage sliding rail 5 and the third-stage sliding rail instead of being directly installed on the guiding rail 301.

An intermediate sliding rail can be provided between the first-stage sliding rail 4 and the guiding rail 301, and the intermediate sliding rail is provided with a movable pulley, the flexible cable wraps the first fixed pulley 6 and the movable pulley (in the absence of special limitations, the movable pulley refers to a first movable pulley 8 and a second movable pulley 9 provided on the second-stage sliding rail 5, or it further includes movable pulleys provided on other intermediate sliding rails when more intermediate sliding rails are included), so that the first-stage sliding rail 4 moves relative to the intermediate sliding rail, and the intermediate sliding rail moves relative to the guiding rail 301. The number of intermediate sliding rails is not limited. When there is one intermediate sliding rail, the intermediate sliding rail is a second-stage sliding rail 5; when there is two intermediate sliding rails, the intermediate sliding rails includes a second-stage sliding rail 5 and a third-stage sliding rail; and when there is three intermediate sliding rails, the intermediate sliding rail includes a second-stage sliding rail 5, a third-stage sliding rail and a fourth-stage sliding rail; and so on. When intermediate sliding rails are provided, the first-stage sliding rail 4 is installed on the sliding rail through the intermediate sliding rails such as the second-stage sliding rail 5 and the third-stage sliding rail instead of being directly installed on the guiding rail 301.

According to the embodiments of the present application, the intermediate sliding rail including the second-stage sliding rail 5 is taken as an example. The second-stage sliding rail 5 is installed on the guiding rail 301 and is configured to slide along the guiding rail 301, and the second-stage sliding rail 5 is provided with the first movable pulley 8 and the second movable pulley 9. The first-stage sliding rail 4 is provided on the second-stage sliding rail 5 and is configured to move relative to the second-stage sliding rail 5. The flexible cable 2 wraps the first fixed pulley 6, the first movable pulley 8 and the second movable pulley 9 in sequence. By providing the second-stage sliding rail 5, the linear motion mechanism can perform multistage telescopic motions, which ensures the telescopic route of the linear motion mechanism.

According to the embodiments of the present application, when the linear motion mechanism includes both the first-stage sliding rail 4 and the second-stage sliding rail 5, the linear motion mechanism can perform second-stage telescopic motion, which corresponds to a third-stage linear motion. The linear motion mechanism can further include a third-stage sliding rail, a fourth-stage sliding rail, a fifth-stage sliding rail or the like (the sliding rail refers to at least one of the first-stage sliding rail 4, second-stage sliding rail 5, third-stage sliding rail and the like.), the specific number of the sliding rails is not limited and can be determined according to requirements. The first-stage sliding rail 4 refers to the first sliding rail led by the rotation of the rotating driving member to perform telescopic motion. The second-stage sliding rail 5 refers to the second sliding rail led by the continuous motion of the rotating driving member to perform telescopic motion when the first-stage sliding rail 4 moves to a limiting position. the three-stage slide refers to the third sliding rail led by the continuous motion of the rotating driving member to perform telescopic motion when the second-stage sliding rail 5 moves to the limiting position; and so on.

According to the embodiments of the present application, the linear motion mechanism further includes a sliding block 7, which is fixed on the first-stage sliding rail 4 and configured to linear motion along the second-stage sliding rail 5, and the sliding block 7 is fixedly connected to the flexible cable segment on two sides of the rotating wheel 1. The fixing form between the sliding block 7 and the flexible cable segment is not limited. For example, the sliding block 7 and the flexible cable segment can be bound, or the sliding block 7 and the flexible cable segment can be welded.

The providing of the sliding block 7 can facilitate the assembly between the first-stage sliding rail 4 and the second-stage sliding rail 5, and can facilitate the providing of flexible cable 2. The flexible cable segment on two sides of the rotating wheel 1 can also be directly connected to the first-stage sliding rail 4 without providing the sliding block 7.

Figure 2:
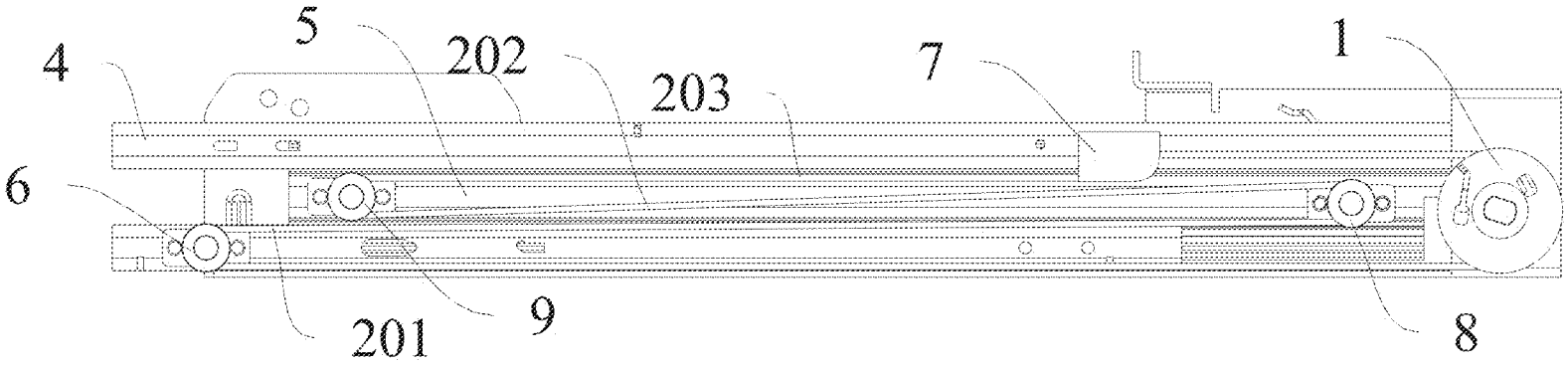
FIG. 2 is a front view of a linear motion mechanism provided by an embodiment of the present application, where a first-stage sliding rail and a second-stage sliding rail are in a retraction position.
Figure 3:
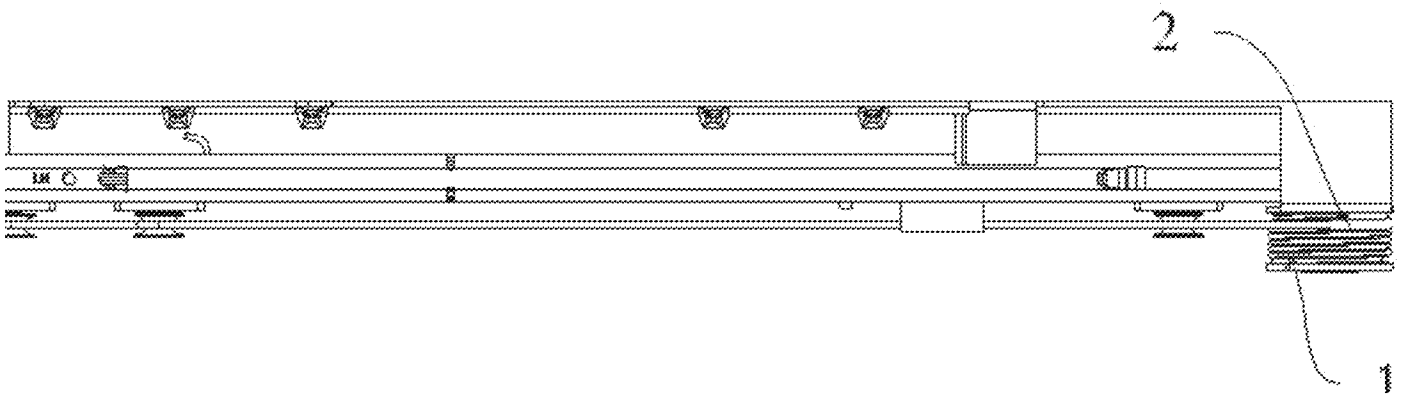
FIG. 3 is a top view of a linear motion mechanism provided by an embodiment of the present application, where a first-stage sliding rail and a second-stage sliding rail are in a retraction position.
Figure 4:
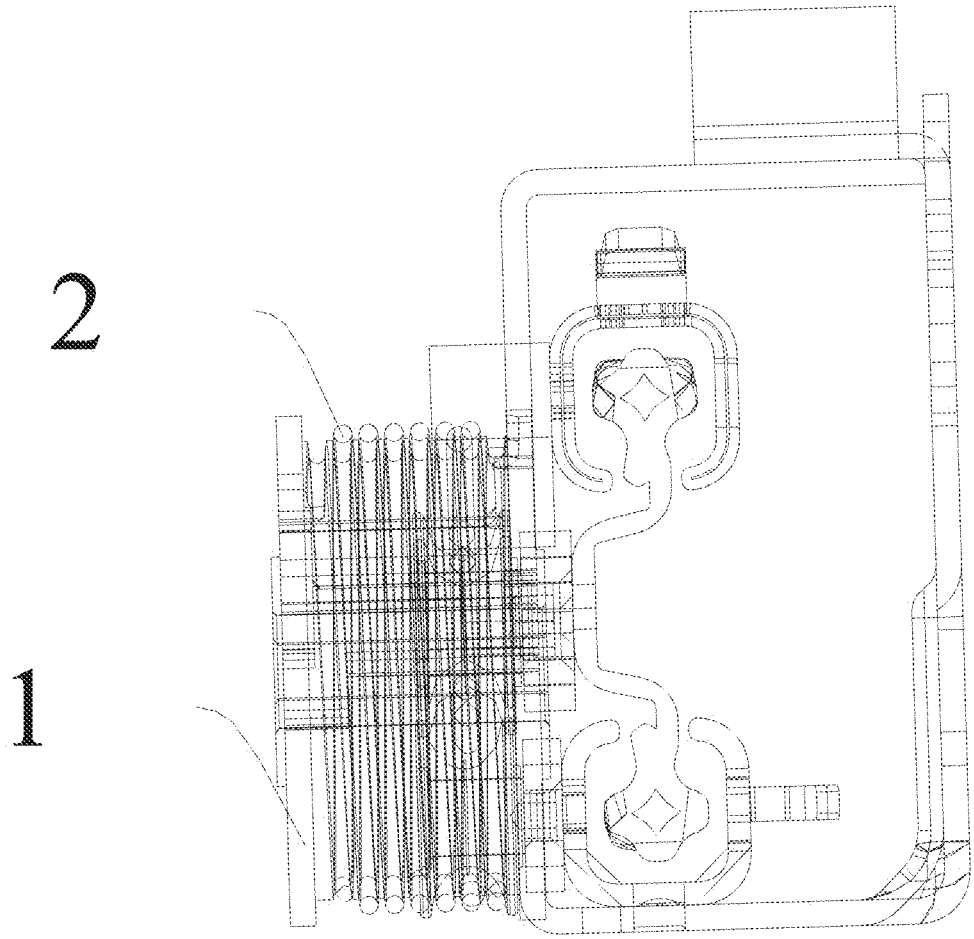
FIG. 4 is a right view of a linear motion mechanism provided by an embodiment of the present application
Figure 5:
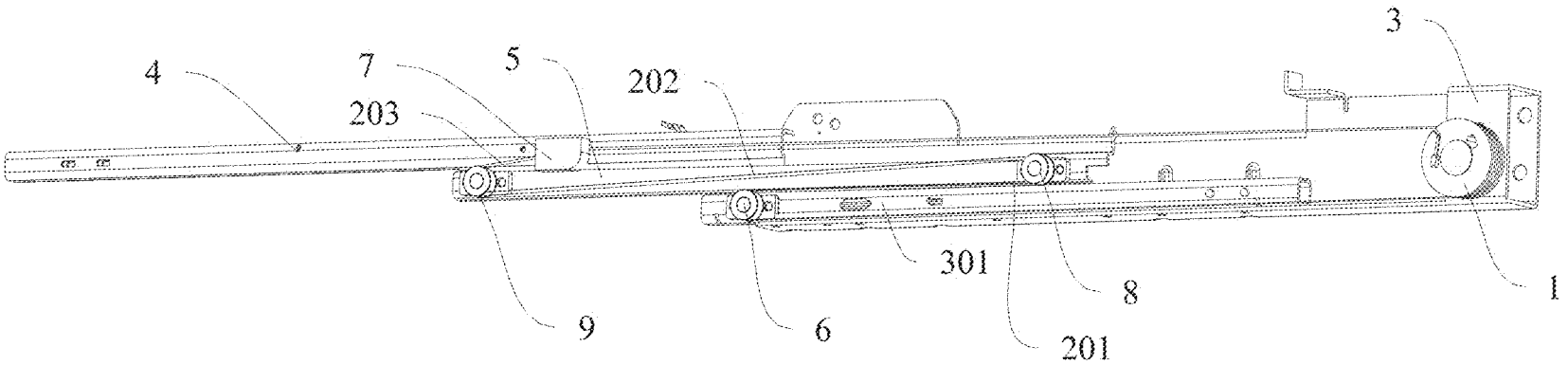
FIG. 5 is an axis side view of a linear motion mechanism provided by an embodiment of the present application, where a first-stage sliding rail is in an extension position.
Figure 6:
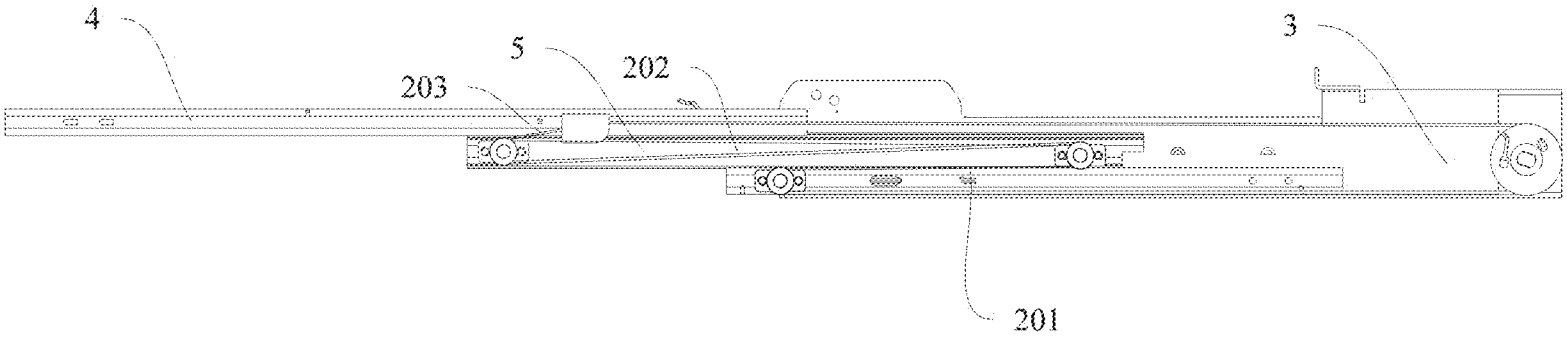
FIG. 6 is a front view of a linear motion mechanism provided by an embodiment of the present application, where a first-stage sliding rail is in an extension position.
Figure 7:
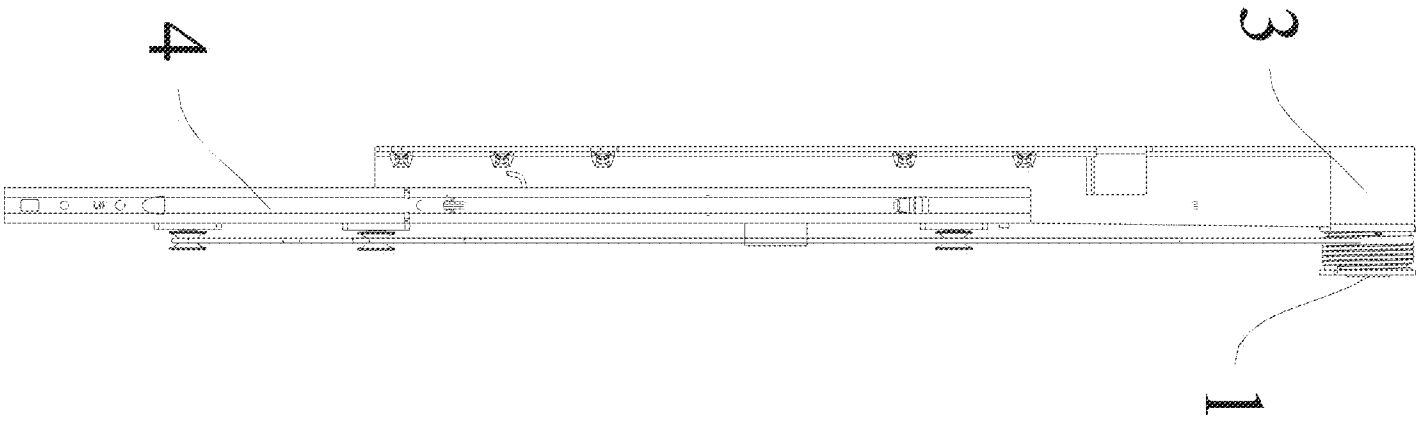
FIG. 7 is a top view of a linear motion mechanism provided by an embodiment of the present application, where a first-stage sliding rail is in an extension position.

According to the embodiments of the present application, the sliding block 7 is fixed at a back end of the first-stage sliding rail 4 along the extension direction of the first-stage sliding rail 4 relative to the second-stage sliding rail 5, referring to FIG. 1 to FIG. 3, that is, the sliding block 7 is provided at the back end of the first-stage sliding rail 4. In this case, the route of the first-stage sliding rail 4 relative to the second-stage sliding rail 5 can be ensured. The sliding block 7 can also be provided at other positions of the first-stage sliding rail 4 when the route of the first-stage sliding rail 4 meets the requirements.

According to the embodiments of the present application, the first movable pulley 8 and the second movable pulley 9 are located at two ends of the second-stage sliding rail 5 respectively, and the route of the second-stage sliding rail 5 relative to the guiding rail 301 is ensured. In combination with FIG. 1 to FIG. 3, the first movable pulley 8 is provided at a right end of the second-stage sliding rail 5, and the second movable pulley 9 is provided at a left end of the second-stage sliding rail 5.

In an embodiment, the first movable pulley 8 and the second movable pulley 9 can be provided at other positions of the second-stage sliding rail 5 when the route of the second-stage sliding rail 5 meets the requirements.

According to the embodiments of the present application, the flexible cable 2 includes a first flexible cable segment 201, a second flexible cable segment 202 and a third flexible cable segment 203. The first flexible cable segment 201 is located between the first fixed pulley 6 and the first movable pulley 8; the second flexible cable segment 202 is located between the first movable pulley 8 and the second movable pulley 9; and the third flexible cable segment 203 is located between the second movable pulley 9 and the first-stage sliding rail 4.

In FIG. 1, certain angles are provided between the first flexible cable segment 201, the second flexible cable segment 202 and the third flexible cable segment 203. In order to ensure the smooth operation of the flexible cable 2 and save the power of the rotating driving member under the same conditions, the first flexible cable segment 201, the second flexible cable segment 202 and the third flexible cable segment 203 can be provided in parallel with each other.

According to the embodiments of the present application, the rotating wheel 1 is provided on the installation member 3. In this case, all members of the linear motion mechanism can be ensured to be as concentrated as possible, and the convenience during assembly and disassembly is ensured.

The rotating wheel 1 can also be provided at other positions, as long as the rotating driving member can lead the flexible cable 2 to move through the rotating wheel 1. In addition, the position of the rotating driving member being provided is not limited, as long as the rotating wheel 1 can be driven to rotate. In particular, when the above linear motion mechanism is applied to a refrigerator, the rotating driving member has no spatial constraint, which can facilitate the providing of the linear motion mechanism in the refrigerator.

According to the embodiments of the present application, taking the rotating driving member being a motor as an example, the motor does not need to move following the sliding rail of the linear motion mechanism, which avoids the dynamic bending of a wire of the motor.

According to the embodiments of the present application, when the linear motion mechanism further includes the second-stage sliding rail 5 and the first movable pulley 8 and the second movable pulley 9 provided on the second-stage sliding rail 5, the rotating wheel 1 is provided corresponding to the first fixed pulley 6, the first movable pulley 8 and the second movable pulley 9, and a diameter of the rotating wheel 1 is larger than that of the first fixed pulley 6, the first movable pulley 8 and the second movable pulley 9. The "the rotating wheel 1 is provided corresponding to the first fixed pulley 6, the first movable pulley 8 and the second movable pulley 9" refers to that the rotating wheel 1 is provided on a straight line where the first movable pulley 8 and the second movable pulley 9 are located, or the straight line where the first movable pulley 8 and the second movable pulley 9 are located has small distance to the rotating wheel 1, and then the smooth motion of the flexible cable 2 is ensured. In addition, the diameter of the rotating wheel 1 is larger than that of the first movable pulley 8 and the second movable pulley 9, and then the flexible cable segments on the two sides of the rotating wheel 1 being tangent to the rotating wheel 1 is ensured, to further ensure the smooth operation of the flexible cable 2.

In FIG. 3 to FIG. 7, the flexible cable segments on two sides of the rotating wheel 1 include the flexible cable segment extending from an upper side of the rotating wheel 1 and the flexible cable segment extending from a lower side of the rotating wheel. The flexible cable segment extending from the lower side of the rotating wheel 1 includes a flexible cable segment between the rotating wheel 1 and the first fixed pulley 6, as well as the first flexible cable segment 201, the second flexible cable segment 202 and the third flexible cable segment 203 mentioned above. In addition, the flexible cable segment extending from the upper side of the rotating wheel 1 includes a flexible cable segment between the rotating wheel 1 and the first-stage sliding rail 4.

When the rotating wheel 1 rotates counterclockwise, the flexible cable segment between the rotating wheel 1 and the first fixed pulley 6 moves to the right and leads the first fixed pulley 6 to move counterclockwise; the first flexible cable segment 201 moves to the left and leads the first movable pulley 8 to rotate clockwise, the second flexible cable segment 202 moves to the right and leads the second movable pulley 9 to move counterclockwise, the third flexible cable segment 203 moves to the left and leads the first-stage sliding rail 4 to move to the left through the sliding block 7. When the first-stage sliding rail 4 moves to the left to the limiting position, if the rotating wheel 1 continues to rotate counterclockwise, since the first flexible cable segment 201 moves to the left, the first movable pulley 8 is driven to move to the left, and then the second-stage sliding rail 5 moves to the left. When the first-stage sliding rail 4 moves to the left, a flexible cable segment between the rotating wheel 1 and the sliding block 7 becomes longer, and the flexible cable segment between the second-stage movable pulley 9 and the sliding block 7 becomes shorter. When the second-stage sliding rail 5 moves to the left, a flexible cable segment between the first fixed pulley 6 and the first movable pulley 8 becomes shorter, and the flexible cable segment between the rotating wheel 1 and the sliding block 7 continues to become longer.

When the rotating wheel 1 rotates clockwise, the flexible cable segment between the rotating wheel 1 and the first-stage sliding rail 4 moves to the right, and then the first-stage sliding rail 4 is driven to move to the right. When the first-stage sliding rail 4 moves to the right to the limiting position, if the rotating wheel 1 continues to rotate clockwise, since the flexible cable segment between the rotating wheel 1 and the first-stage sliding rail 4 continues to move to right, and then a third flexible cable segment 203 between the first-stage sliding rail 4 and the second-stage movable pulley 9 will also move right, and lead the second-stage movable pulley 9 to move right to drive the second-stage sliding rail 5 to move to the right. When the first-stage sliding rail 4 moves to the right, the flexible cable segment between the rotating wheel 1 and the sliding block 7 becomes shorter, and the flexible cable segment between the second movable pulley 9 and the sliding block 7 becomes longer. When the second-stage sliding rail 5 moves to the right, the flexible cable segment between the first fixed pulley 6 and the first movable pulley 8 becomes longer, and the flexible cable segment between the rotating wheel 1 and the sliding block 7 continues to become shorter.

Figure 8:
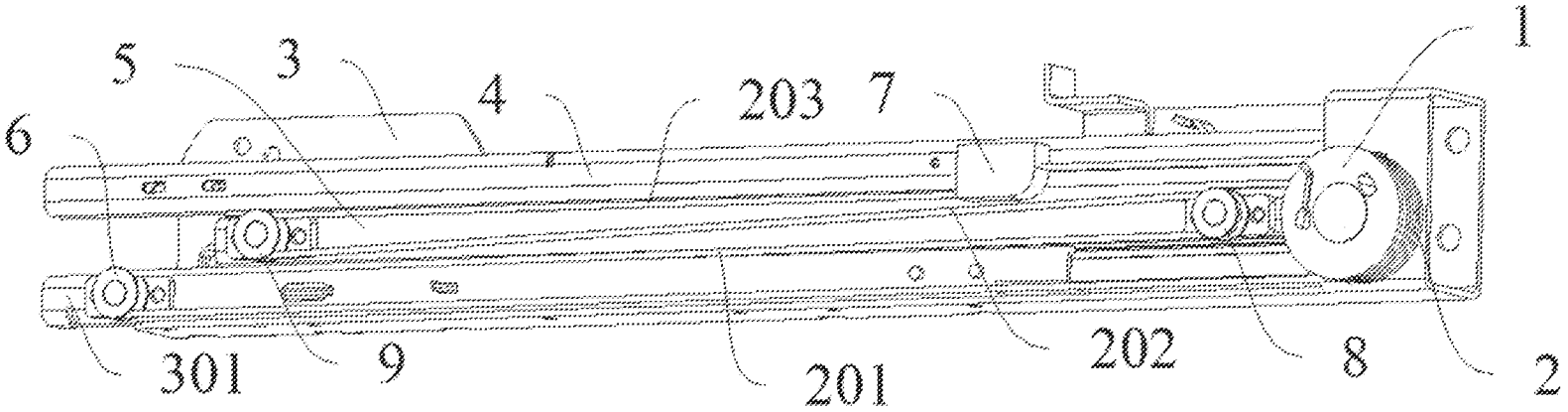
FIG. 8 is a side view of a linear motion mechanism provided by an embodiment of the present application, where the linear motion mechanism includes a second fixed pulley.

According to the embodiments of the present application, referring to FIG. 8, the linear motion mechanism further includes a second fixed pulley 10, and the second fixed pulley 10 is provided to the installation member 3. In this case, the flexible cable 2 wraps the second fixed pulley 10 and the first fixed pulley 6 in sequence. When the linear motion mechanism includes the first movable pulley 8 and the second movable pulley 9, the flexible cable 2 wraps the second fixed pulley 10, the first fixed pulley 6, the first movable pulley 8 and the second movable pulley 9 in sequence. The providing of the second fixed pulley 10 can make the providing of the rotating wheel 1 more flexible. For example, the rotating wheel 1 can be provided outside the installation member 3. When the linear motion mechanism is installed in a drawer body, the installation position of the rotating wheel 1 and the rotating driving member relative to the drawer body is selected according to the situation.

In an embodiment, the first fixed pulley 6 is located at a first end of the guiding rail 301, and the second fixed pulley 10 is located at a second end of the guiding rail 301. Alternatively, the second fixed pulley 10 is located on an extension path of the guiding rail 301 and is close to the second end of the guiding rail 301. By providing the position relationship between the first fixed pulley 6 and the second fixed pulley 10 reasonably, the smooth operation of the flexible cable is ensured. The providing position of the second fixed pulley 10 is not limited, as long as the flexible cable 2 can move smoothly along the directions of the rotating wheel 1, the second fixed pulley 10, the first fixed pulley 6, the first movable pulley 8 and the second movable pulley 9.

According to the embodiments of the present application, the rotating wheel 1 can be a synchronous belt wheel or a pulley, and the flexible cable 2 can be a belt or a flexible belt with high friction coefficient. For example, the rotating wheel 1 can select the belt wheel and the flexible cable 2 can select the belt matching the belt wheel. This situation can ensure that when the rotating wheel 1 rotates, the flexible cable 2 is led to move, and avoids the flexible cable 2 slipping relative to the rotating wheel 1. Similarly, the specific structure of the flexible cable 2 is not limited, for example, it can be a wire rope.

The specific structural form of the rotating wheel 1 and flexible cable 2 is not limited, as long as the rotation of the rotating wheel 1 can lead the flexible cable 2 to move, and prevent the flexible cable 2 from slipping as far as possible.

According to the embodiments of the present application, the rotating driving member can be, but is not limited to, a motor including a linear motor and a rotary motor, as long as the rotating driving member can be used as a power source to drive the rotating wheel 1 to rotate. For example, the rotating driving member can also be a pneumatic cylinder, which can convert the linear motion into rotation of the rotating wheel 1 through a gear rack pair.

According to the embodiments of the present application, several tensioning wheels can be provided in the extension direction of flexible cable 2 to ensure that flexible cable 2 is in a tensioning state. For example, when a second fixed pulley 10 is provided, and the rotating wheel 1 and the rotating driving member are provided outside the installation member, in order to avoid the loosening of the flexible cable between the rotating wheel 1 and the second fixed pulley 10, a tension wheel can be provided between the second fixed pulley 10 and the rotating wheel 1. The tensioning wheel can adjust a direction of the flexible cable between the rotating wheel 1 and the second fixed pulley 10.

According to the embodiments of the present application, a drawer assembly is provided, which includes a drawer body, and further includes the linear motion mechanism mentioned above. The drawer body is fixed on the first-stage sliding rail 4.

According to the embodiments of the present application, the rotating wheel 1 is driven to rotate by the rotating driving member, and the flexible cable 2 is led to move, to make the first-stage sliding rail 4 slide relative to the guiding rail. Further, when the drawer body is installed on the first-stage sliding rail 4, the drawer body can move relative to the installation member 3, so that the drawer can be pulled automatically.

It should be noted that the drawer assembly that can be pulled automatically in the present application can be modified on the basis of the drawer assembly in related art. In an embodiment, it only needs to add with the rotating wheel 1, rotating driving member and fixed pulley, or further add the movable pulley, thereby having lower preparation cost.

According to the embodiments of the present application, the automatic pulling of the drawer body can be controlled by providing with a corresponding switch or sensor. For example, a switch is provided in a panel portion of the drawer body, and then the drawer is automatically extended by pressing the switch, and the drawer is automatically retracted by pressing the switch again. For example, a sensor is provided in the panel portion of the drawer body. When the sensor senses a corresponding action, such as when a hand is approaching, a signal is generated to control the drawer body to extend or retract.

According to the embodiments of the present application, a storage cabinet is provided, which includes a box body and a drawer body and/or a shelf provided in the box body, and further includes the linear motion mechanism mentioned above, where the linear motion mechanism is provided on at least one side of the drawer body and/or shelf, the drawer body and/or shelf are fixed on the first-stage sliding rail 4, and the installation member 3 is fixed on the box body.

That is, the box body is provided with at least one of the drawer body and shelf. On this basis, both the drawer body and the shelf can be provided in the box body through the above linear motion mechanism.

The drawer body and/or shelf of a storage cabinet according to the present application embodiment can be pulled automatically to facilitate the taking and placing of object. In addition, the linear motion mechanism between the drawer body and/or the shelf and the box body have small space occupation and a simple structure, thereby hardly occupying additional space inside the box body. In addition, the linear motion mechanism has low preparation cost and is convenient to be assembled and disassembled, which has high applicability, and can be applied to various products such as refrigerators, wardrobes, and display cabinets.

The installation member 3 can be a detachable individual member provided in the box body, and the installation member 3 can also be integrated into the box body.

According to the storage cabinet of the present application embodiment, the first-stage sliding rail 4 and the installation member 3 are provided along a height direction of the storage cabinet in sequence. Therefore, the weight of the drawer body or the shelf is transmitted to the installation member 3 through the first-stage sliding rail 4, and the installation member 3 needs to have sufficient structural strength. The first-stage sliding rail 4 can be fixed to the side wall of the drawer body or the shelf. In this case, the lateral space occupied by the linear motion mechanism is small.

According to the storage cabinet of another embodiment of the present application, the first-stage sliding rail 4 and the installation member 3 are provided along a width direction of the storage cabinet in sequence, and the first-stage sliding rail 4 is fixed with the bottom plate of the drawer or the bottom plate of the shelf. In this case, the main function of the installation member 3 is to guide the moving direction of the first-stage sliding rail 4 by providing the guiding rail 301. The drawer body or shelf can be supported by an additional load-bearing member. Further, in order to ensure that the drawer body or shelf to move relative to the installation member 3, a roller can be provided in the drawer body or at a bottom of the shelf, and the rolling friction between the roller and load-bearing member can ensure that the drawer body or shelf move smoothly. In this case, there is no great requirement for the structural strength of the installation member 3, as long as the guiding rail 301 can play a guiding role on the first-stage sliding rail 4.

According to the storage cabinet of the present application embodiment, the rotating wheel 1 is installed on an inner side of the storage cabinet. When the rotating wheel 1 moves, a certain noise will be generated. By installing the rotating wheel 1 on the inner side of the storage cabinet, the noise generated from the storage cabinet can be reduced. The "the inner side of the storage cabinet" refers to a side distal to the door, and a side near the door refers to an outside of the storage cabinet. During use, the "the inner side of the storage cabinet" is a side distal to the user.

According to the storage cabinet of the present application, the storage cabinet can be a refrigerator, a retail cabinet or a display cabinet, and the specific structural form of the storage cabinet is not limited by the embodiment here. The linear motion mechanism of the embodiments of the present application is not limited to the storage cabinet of the present application, but can be used in other occasions, for example, a drawer of a desk, a flat door and a telescopic manipulator can switch states through the above linear motion mechanism.

The following takes the extension and retraction of the drawer in the refrigerator as an example to explain the linear motion mechanism of the present application.

The installation member 3 of the linear motion mechanism in FIG. 1 to FIG. 7 is installed on a tank of the refrigerator, and the first-stage sliding rail 4 of the linear motion mechanism is provided on the drawer body.

When food needs to be taken or placed on an outer side of the drawer body, the first-stage sliding rail 4 of the linear motion mechanism is triggered to extend relative to the second-stage sliding rail 5. If food needs to be taken or placed on an inner side of the drawer body, the second-stage sliding rail 5 of the linear motion mechanism is triggered to extend relative to the guiding rail. In an embodiment, the rotating driving member leads the rotating wheel 1 to move counterclockwise so that the first-stage sliding rail 4 and even the second-stage sliding rail 5 to extend out. The sensor can be provided at a corresponding position of the refrigerator. When a corresponding operation is continuously sensed, the rotating driving member continues to operate, so that the drawer body gradually extends out. When the corresponding operation disappears, the rotating driving member no longer operates, and the drawer body stops at the current position. For example, a pressing sensor is provided in the drawer body, the door body or the tank. Since being subjected to a pressing operation, the rotating driving member continuously drives the rotating wheel 1 to rotate to lead the drawer body to extend out. For another example, the pressure sensor can also be replaced by an infrared sensor or other type of sensor. When the drawer body needs to be retracted, there is no need for continuous sensing, and only one operation is needed to retract the drawer body. The linear motion mechanism can also be controlled based on sound signals. For example, based on sound information such as "open the drawer" or "close the drawer", the drawer body can switch states.

The above embodiments are only used to illustrate the present application, rather than limiting the present application. Although the present application is described in detail with reference to the above embodiments, those of ordinary skill in the art should understand that the various combinations, modifications or equivalent replacements of the solutions of the present application are not departed from the scope of the solutions of the present application, and should be covered in the scope of the claims of the present application.

What is claimed is:

1. A linear motion mechanism, comprising:

a rotating wheel, wrapped by a flexible cable, wherein the flexible cable is configured to move as the rotating wheel rotating, and the flexible cable comprises a flexible cable segment located on two sides of the rotating wheel;

a rotating driving member, connected with the rotating wheel, and configured to drive the rotating wheel to rotate;

an installation member, provided with a guiding rail, wherein a first fixed pulley is installed on the installation member;

a first-stage sliding rail, configured to slide relative to the guiding rail; and a second-stage sliding rail installed on the guiding rail and configured to slide along the guiding rail, the second-stage sliding rail being provided with a first movable pulley and a second movable pulley; wherein the flexible cable wraps the first fixed pulley, and the flexible cable segment of the flexible cable located on the two sides of the rotating wheel are connected to the first-stage sliding rail;

a number of intermediate sliding rails are provided between the first-stage sliding rail and the guiding rail, and the first-stage sliding rail is installed on the guiding rail through the intermediate sliding rails, the intermediate sliding rail is provided with a movable pulley, and the flexible cable wraps the first fixed pulley and the movable pulley in sequence;

the first-stage sliding rail is installed on the second-stage sliding rail and is configured to move relative to the second-stage sliding rail; and the flexible cable wraps the first fixed pulley, the first movable pulley and the second movable pulley in sequence.

2. The linear motion mechanism according to claim 1, further comprising:

a sliding block, fixed on the first-stage sliding rail and configured to perform linear motion along the second-stage sliding rail, and fixedly connected to the flexible cable segment on the two sides of the rotating wheel.

3. The linear motion mechanism according to claim 2, wherein the sliding block is fixed at a back end of the first-stage sliding rail along an extension direction of the first-stage sliding rail relative to the second-stage sliding rail.

4. The linear motion mechanism according to claim 1, wherein the first movable pulley and the second movable pulley are respectively provided at two ends of the second-stage sliding rail.

5. The linear motion mechanism according to claim 1, wherein the flexible cable comprises:

a first flexible cable segment, located between the first fixed pulley and the first movable pulley;

a second flexible cable segment, located between the first movable pulley and the second movable pulley; and a third flexible cable segment, located between the second movable pulley and the first-stage sliding rail; and, wherein the first flexible cable segment, the second flexible cable segment and the third flexible cable segment are parallel, or angles are provided between the first flexible cable segment and the second flexible cable segment, and between the second flexible cable segment and the third flexible cable segment.

6. The linear motion mechanism according to claim 1, wherein the rotating wheel is provided on the installation member.

7. The linear motion mechanism according to claim 6, wherein when the linear motion mechanism further comprises a second-stage sliding rail and a first movable pulley and a second movable pulley provided on the second-stage sliding rail, the rotating wheel is provided correspondingly to the first fixed pulley, the first movable pulley and the second movable pulley, and a diameter of the rotating wheel is larger than diameters of the first fixed pulley, the first movable pulley and the second movable pulley.

8. The linear motion mechanism according to claim 1, further comprising:

a second fixed pulley, provided on the installation member, wherein the flexible cable wraps the second fixed pulley and the first fixed pulley in sequence; and, wherein the first fixed pulley is located at a first end of the guiding rail, and the second fixed pulley is located at a second end of the guiding rail, or the second fixed pulley is located on an extended path of the guiding rail and close to the second end of the guiding rail.

9. The linear motion mechanism according to claim 1, wherein the rotating wheel is a belt wheel, and the flexible cable is a belt matching with the belt wheel.

10. A drawer assembly, comprising a drawer body and the linear motion mechanism according to claim 1, wherein the drawer body is fixed on the first-stage sliding rail.

11. A storage cabinet, comprising a box body and a drawer body and/or a shelf provided in the box body, and the linear motion mechanism according to claim 1, wherein the linear motion mechanism is provided on at least one side of the drawer body and/or the shelf, the drawer body and/or the shelf are fixed on the first-stage sliding rail, and the installation member is fixed on the box body.

12. The storage cabinet according to claim 11, wherein the first-stage sliding rail and the installation member are provided along a height direction of the storage cabinet in sequence, and the first-stage sliding rail is fixed with a side wall of the drawer body or a side wall of the shelf.

13. The storage cabinet according to claim 11, wherein the first-stage sliding rail and the installation member are provided along a width direction of the storage cabinet in sequence, and the first-stage sliding rail is fixed with a bottom plate of the drawer body or a bottom plate of the shelf.

14. The storage cabinet according to claim 11, wherein the rotating wheel is installed on an inner side of the storage cabinet.

15. The storage cabinet according to claim 11, wherein the storage cabinet is a refrigerator, a retail cabinet or a display cabinet.

* * * * *